US011001352B1

(12) United States Patent
Nassim

(10) Patent No.: US 11,001,352 B1
(45) Date of Patent: May 11, 2021

(54) VESSEL AND SYSTEM FOR REMOVING REFUSE FROM A BODY OF WATER

(71) Applicant: Elias Nassim, Fort Lauderdale, FL (US)

(72) Inventor: Elias Nassim, Fort Lauderdale, FL (US)

( * ) Notice: Subject to any disclaimer, the term of this patent is extended or adjusted under 35 U.S.C. 154(b) by 0 days.

(21) Appl. No.: 17/010,016

(22) Filed: Sep. 2, 2020

Related U.S. Application Data

(60) Provisional application No. 62/925,326, filed on Oct. 24, 2019.

(51) Int. Cl.
*E02B 15/04* (2006.01)
*B63B 35/32* (2006.01)
*E02B 15/10* (2006.01)

(52) U.S. Cl.
CPC ..... *B63B 35/32* (2013.01); *E02B 15/046* (2013.01); *E02B 15/048* (2013.01); *E02B 15/104* (2013.01); *E02B 15/108* (2013.01)

(58) Field of Classification Search
CPC ..... E02B 15/046; E02B 15/048; E02B 15/10; E02B 15/104; B63B 35/32
USPC ... 210/170.05, 170.09, 170.11, 242.1, 747.6, 210/776, 923
See application file for complete search history.

(56) References Cited

U.S. PATENT DOCUMENTS 3,539,048 A * 11/1970 Pearson ..... E02B 15/046 210/242.3
3,700,108 A * 10/1972 Richards ..... E02B 15/104 210/923
3,862,904 A * 1/1975 Weatherford ..... E02B 15/046 210/776
4,060,487 A * 11/1977 Samsel ..... E02B 15/046 210/923
4,322,294 A * 3/1982 Price ..... E02B 15/104 210/242.3
4,842,735 A * 6/1989 Hollis ..... E02B 15/104 210/923
5,028,325 A * 7/1991 Hamilton ..... E02B 15/104 210/242.1
5,173,182 A * 12/1992 Debellian ..... E02B 15/046 210/242.1
5,254,266 A 10/1993 Barnes et al.
10,689,821 B1 * 6/2020 Whittington ..... E02B 15/048
2003/0132154 A1 * 7/2003 Morin ..... B63B 35/32 210/242.1
2006/0065586 A1 * 3/2006 Walczyk ..... B63B 35/32 210/242.1
2007/0158253 A1 * 7/2007 Kellett ..... E02B 15/104 210/776
2020/0208368 A1 * 7/2020 Milanovich ..... E02B 15/104

FOREIGN PATENT DOCUMENTS

AU 2015100062 2/2015
KR 1020150119993 10/2015
KR 20160095787 8/2016
NL 2018882 B1 11/2018
WO 2012018722 2/2012

(Continued)

*Primary Examiner* — Christopher Upton
(74) *Attorney, Agent, or Firm* — Gottlieb, Rackman & Reisman, P.C.

(57) ABSTRACT

A vessel that is configured to remove trash from a body of water includes a trash intake portion, a trash processing portion, a compactor, and a plurality of components configured to allocate compacted trash onboard the vessel.

21 Claims, 11 Drawing Sheets

(56) References Cited

FOREIGN PATENT DOCUMENTS

| | | |
|---|---|---|
| WO | 2014191100 | 12/2014 |
| WO | 2018208159 | 11/2018 |
| WO | 2019007702 | 10/2019 |

* cited by examiner

VESSEL AND SYSTEM FOR REMOVING REFUSE FROM A BODY OF WATER

CROSS-REFERENCE TO RELATED APPLICATION

This non-provisional patent application claims priority under 35 U.S.C. § 119 to U.S. Provisional Patent Application No. 62/925,326, filed on Oct. 24, 2019, the disclosure of which is incorporated by reference herein in its entirety.

TECHNICAL FIELD

The present invention relates to a vessel, and more particularly, to a vessel and a system configured to remove refuse from a body of water.

DISCUSSION OF THE RELATED ART

The rate at which trash is being generated in recent times is problematically high. Some of this refuse inevitably finds its way into water bodies, whether by negligence or intentional disposal.

For example, the Great Pacific garbage patch is a tremendously large collection of trash floating in and over the surface of the Pacific Ocean. Unfortunately, the Great Pacific garbage patch is not the only example of trash in the oceans. Other patches of floating trash have formed in the Atlantic Ocean as well as across the seven seas.

Such trash has severe negative impacts on aquatic life, and is likely to cause an adverse health effect on humans who consume fish and other foods derived from contaminated water bodies.

Attempts to clean floating trash such as the Great Pacific garbage patch have so far failed. One known approach is to release several long and curved floating tubes in the ocean. Each floating tube is permitted to freely drift across the surface of the ocean based on the ocean current, waves and wind.

While drifting, each curved tube is expected to surround/encircle (i.e., capture) a certain amount of floating trash. On some days, however, no trash is captured. A boat or ship is dispatched to the location of each floating tube for the purpose of collecting trash without knowing whether the tube has actually captured any trash. When a tube has failed to collect any trash, the resources spent to dispatch the cleaning crew and vessel into the open ocean are wasted.

Even when the tubes do capture some trash, small waves cause a portion of the captured trash to travel over the top of the tube, thereby releasing the captured trash back into the open ocean.

In addition, the tubes are known to break in the open ocean due to factors such as the current, waves and wind, therefore failing their intended purpose and necessitating costly and time-consuming repairs.

Further, the accumulation of the trash from the tubes by a dispatched boat has proven to be difficult because since the tubes are free to float, they sometimes float away from the boat together with the floating trash while the trash is being collected.

Accordingly, an effective system of collecting trash from water bodies is needed.

SUMMARY

A vessel of the present invention is configured to clean water bodies by extracting floating trash and trash that is submerged to a certain depth out of the water. The vessel may have an intake funnel that is at least partially submerged into the water for retrieving the trash from the water. The vessel may be configured to grind the retrieved trash, to compact the ground trash, and to place the compacted trash into storage bins. The vessel may have a crane for moving the cargo bins where and when needed on the cargo deck or within the interior of the vessel. The vessel may be used to clean trash from freshwater or saltwater bodies.

A system for cleaning water bodies may include a plurality of vessels configured to clean trash from a water body and a supporting ship configured to facilitate the operation of the plurality of vessels. The cleaning vessels may be dispatched as group to clean a large amount of trash from a water body. For example, the vessels may be arranged side-to-side and/or in a chevron configuration in order to clean a large and contiguous area of trash from the water. Alternatively, the vessels may be scattered in small groups or may be scattered as individual units in order to clean trash from different locations of a water body.

Each vessel can be loaded with, for example, about 10 tons to about 20 tons of trash, depending on the size of the vessel. This is a relatively large amount of trash, and the vessel may be configured to house (or fit) such a large quantity of trash in a relatively small cargo deck and/or in a relatively small internal storage chamber because the various trash processing apparatuses that are included in the vessel are configured to densely compact the captured trash. The trash is densely compacted because first it is shredded/chipped/ripped into small pieces, then it is compacted into a dense mass of trash. The shredding/chipping/ripping process enables the captured trash to be tightly (densely) compacted. Merely compacting trash without first shredding/chipping/ripping it would not produce such a dense mass of trash as can be produced by using the apparatuses included in a vessel of the present invention.

In addition, the dense mass of trash may be shrink wrapped with perforated shrink wrap plastic film or otherwise wrapped by using a perforated cover material (or wrapping material) which allows water to leach out of the compacted mass of trash. The leaching of water causes the weight of the compacted mass of trash to be reduced, which reduces the overall weight of the trash, thereby reducing the fuel consumption of the vessel, which in turn increases operating efficiency. In addition, the leaching of water may help keeping the compacted mass of trash as a whole unit (prevents it from crumbling).

A supporting ship (or cargo ship) may be larger than the cleaning vessels and may be used to receive the storage bins (or trash containers) that are filled with compacted trash from the cleaning vessels. For this purpose, the supporting ship may remain within a reasonable distance away from the cleaning vessels while the cleaning vessels operate to clean a water body. The supporting ship may also be used to supply the cleaning vessels with additional empty storage bins once that the full storage bins are offloaded from the cleaning vessels onto the supporting ship. In addition, the supporting ship may be used to refuel the cleaning vessels such that the cleaning operation can be extended as much as possible, weather permitting.

Therefore, a single vessel or a system of cleaning vessels (with the supporting ship) of the present invention may be highly efficient at cleaning a large amount of trash from a water body in a short period of time.

BRIEF DESCRIPTION OF THE DRAWINGS

The above and other features of the present invention will become more apparent by describing in detail exemplary embodiments thereof in conjunction with the accompanying drawings, in which.

DETAILED DESCRIPTION OF THE EMBODIMENTS

Figure 1:
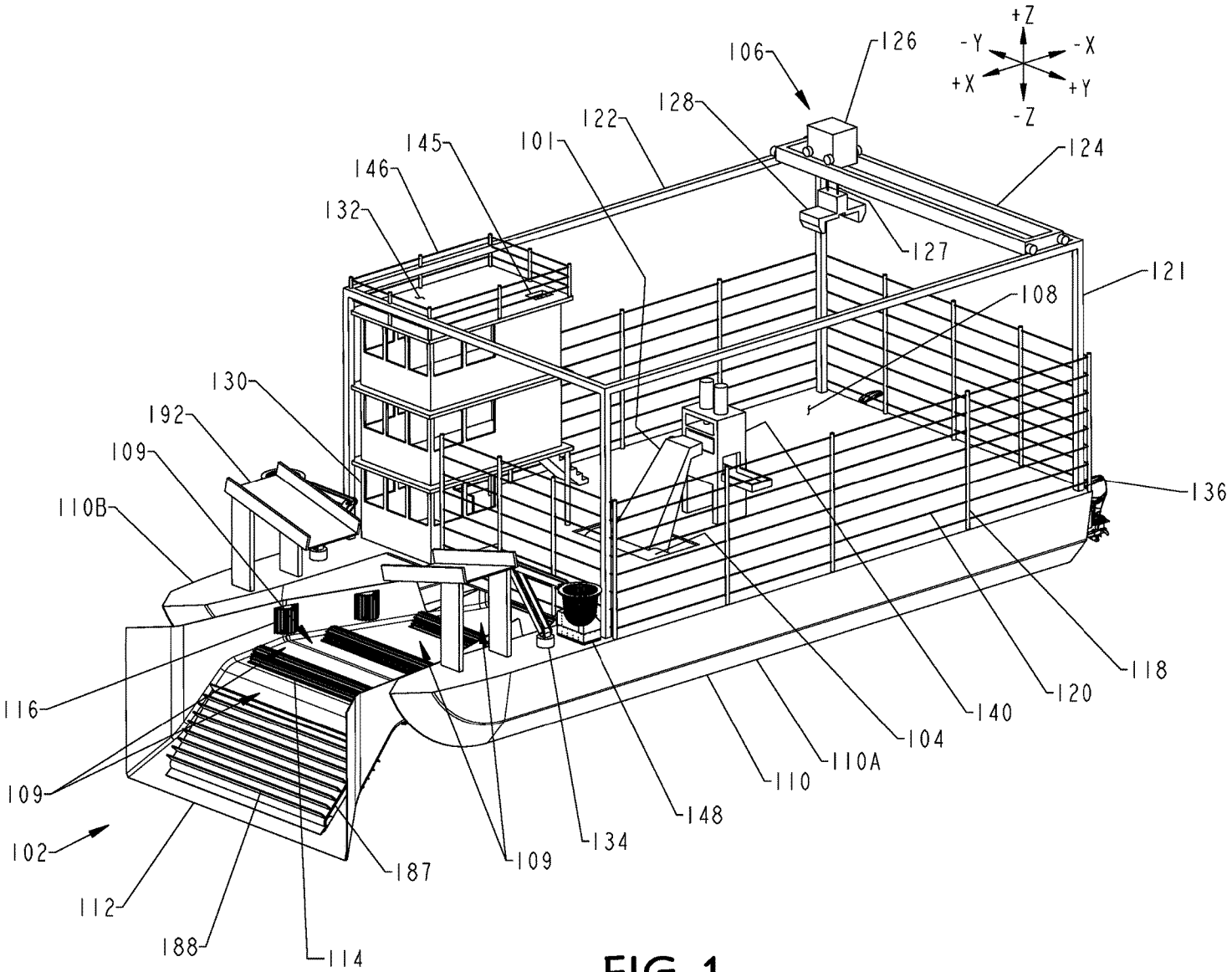
FIG. 1 is a perspective view illustrating the front and left sides of a vessel configured to remove refuse from a water body, according to an exemplary embodiment of the present invention.

Exemplary embodiments of the present invention will be described more fully hereinafter with reference to the accompanying drawings. The present invention may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

FIGS. 1-8 illustrate a vessel configured to retrieve trash from a water body according to an exemplary embodiment of the present invention. Referring to FIGS. 1-8, the vessel may have a plurality of hulls 110, at least one engine 136, a refuse intake portion 102 (see FIGS. 1-3) a trash processing portion 104 (see FIG. 7), a compactor 140 (see FIGS. 1, 3-7, 12 and 13), a system 106 for allocating compacted trash within the vessel, a cargo deck 108 (see FIGS. 1 and 3), a generator 148 (see FIGS. 1-2), and a wheelhouse with quarters 130 (see FIGS. 1-4).

Referring to FIGS. 1-4, the plurality of hulls 110 may include a first hull 110A and a second hull 110B.

As shown in FIGS. 1-4 and 7, the vessel may include a pair of engines 136, and each one of the pair of engines 136 may be disposed at a rear end of the vessel.

As shown in FIGS. 1-4 and 7, each engine 136 may be an outboard engine. However, the present invention is not limited thereto. For example, each of the engines 136 may be an inboard engine (not shown), or the vessel may include a combination of inboard and outboard engines (not shown). In addition, the engines 136 are not limited to being disposed at the rear end of the vessel.

As illustrated in FIGS. 1-4 and 7, each engine 136 may be disposed behind a respective hull 110 in order for the hull 110 to shield the engine 136 (and its propeller) from colliding with floating and partially sunk trash while the vessel is in an operational state of collecting trash from a water body.

The vessel may also be equipped with at least one water jet (not shown) for increased maneuverability. The water jet may include an intake opening located at a portion of the vessel which is normally under the waterline 150 (see FIG. 7), an intake pipe or other conduit configured to convey intake water into a pump (not shown), the pump, which is configured to suction the intake water through the intake opening and to pressurize and eject the intake water in the form of a jet through an output opening, as well as an output pipe or other conduit configured to convey the pressurized water jet to the output opening.

In this case, the intake opening may be provided with a grate or other filtration mechanism in order to prevent trash of various sizes from entering into the intake jet stream; thereby preventing damage to the pump. The output opening may be configured to be rotatable in 360 degrees such that the vessel can have increased maneuverability.

Figure 7:
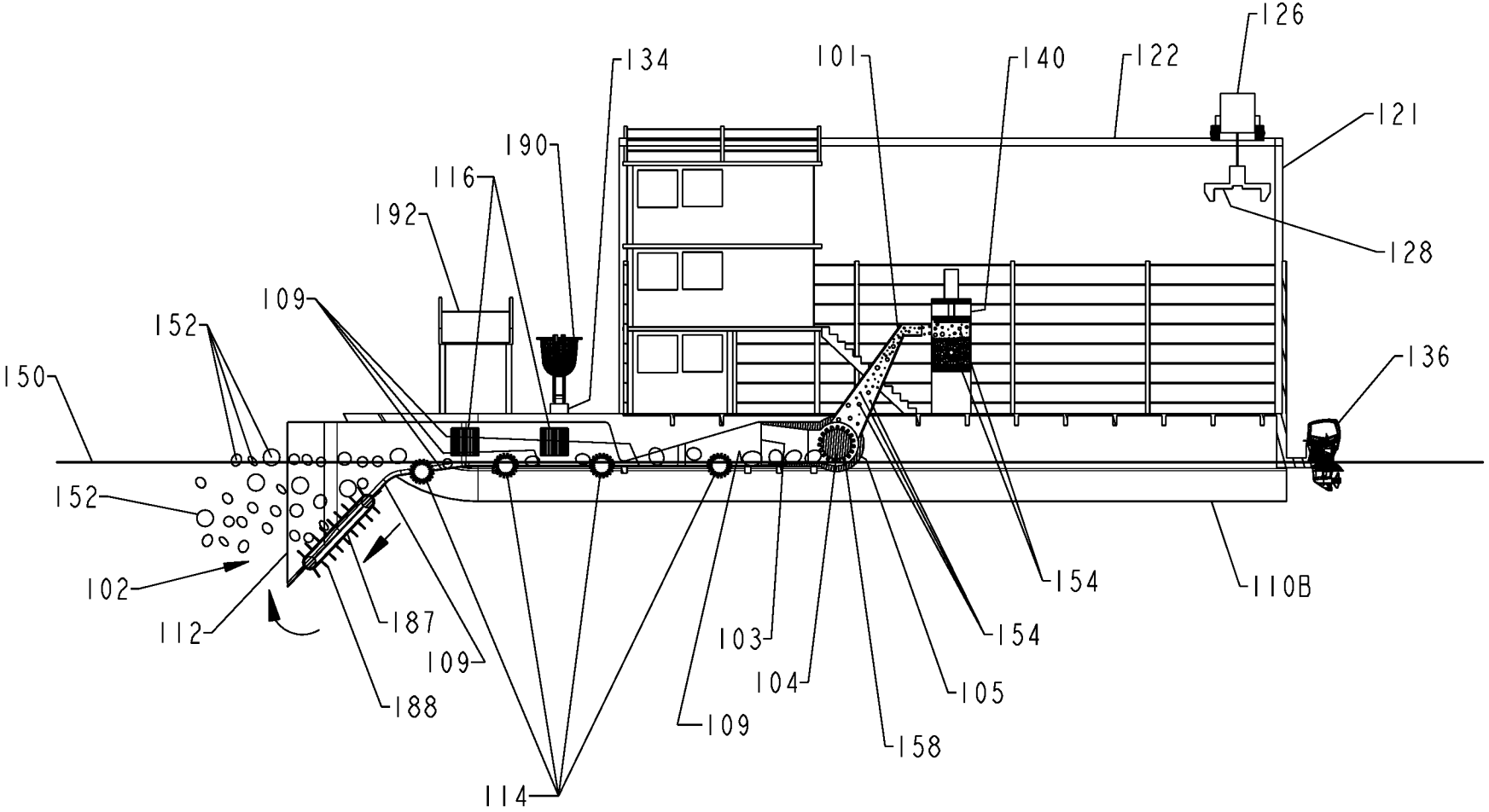
FIG. 7 is a cross-sectional view taken along line A-A of FIG. 5, illustrating the vessel of FIG. 1 according to an exemplary embodiment of the present invention.

The refuse (or trash) intake portion 102 is configured to capture trash floating at the surface of the water (e.g., at the waterline 150) as well as trash that remains suspended within a certain depth from the surface of the water (see FIG. 7). In addition, the trash intake portion 102 is configured to convey the captured trash to the processing portion 104.

Referring to FIGS. 1-4 and 7, the trash intake portion 102 may include a funnel 112, a trash conveyor system (described below) extending between the funnel 112 and the trash processing portion 104, at least one auxiliary crane 134 connected to a net/basket 190, and at least one trash chute 192 configured to be operated in conjunction with the at least one auxiliary crane 134. In another embodiment, hooks might be used in place of, or in combination with, the net/basket 190.

The funnel 112 is configured to capture trash from the water, and may be disposed at a front portion of the vessel as shown in FIGS. 1-7. In addition, the funnel 112 may be configured to convey the captured trash to the trash conveyor system. In an embodiment, the funnel 112 may be embodied as a claw. The claw may be used for capturing floating and partially submerged trash from a body of water into the conveyor belt 109 (described below).

As shown in FIG. 1, the funnel 112 may be disposed between the first and second hulls 110A and 110B. However, the present invention is not limited thereto.

Figure 3:
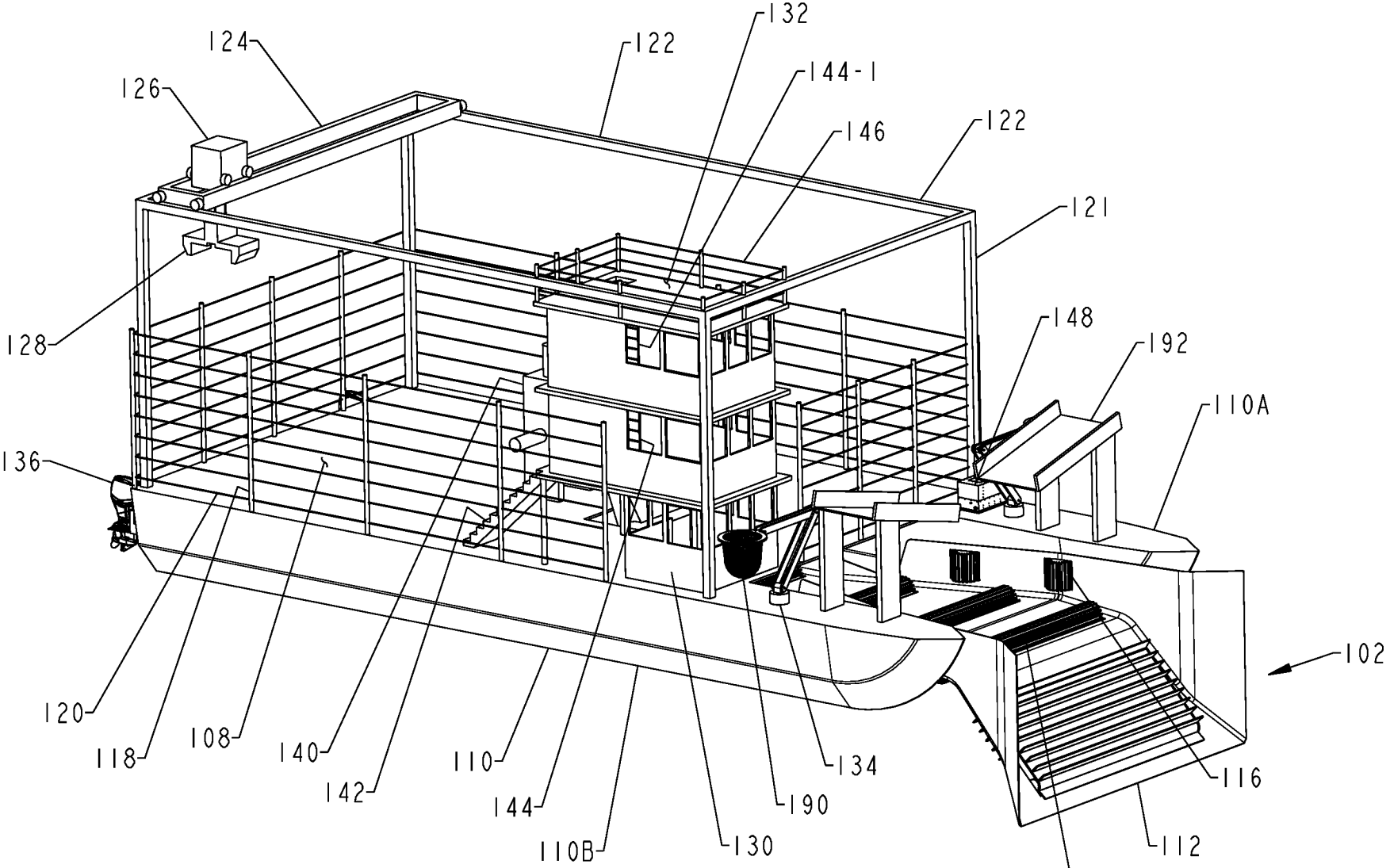
FIG. 3 is a perspective view illustrating the front and right sides of the vessel of FIG. 1, according to an exemplary embodiment of the present invention.
Figure 4:
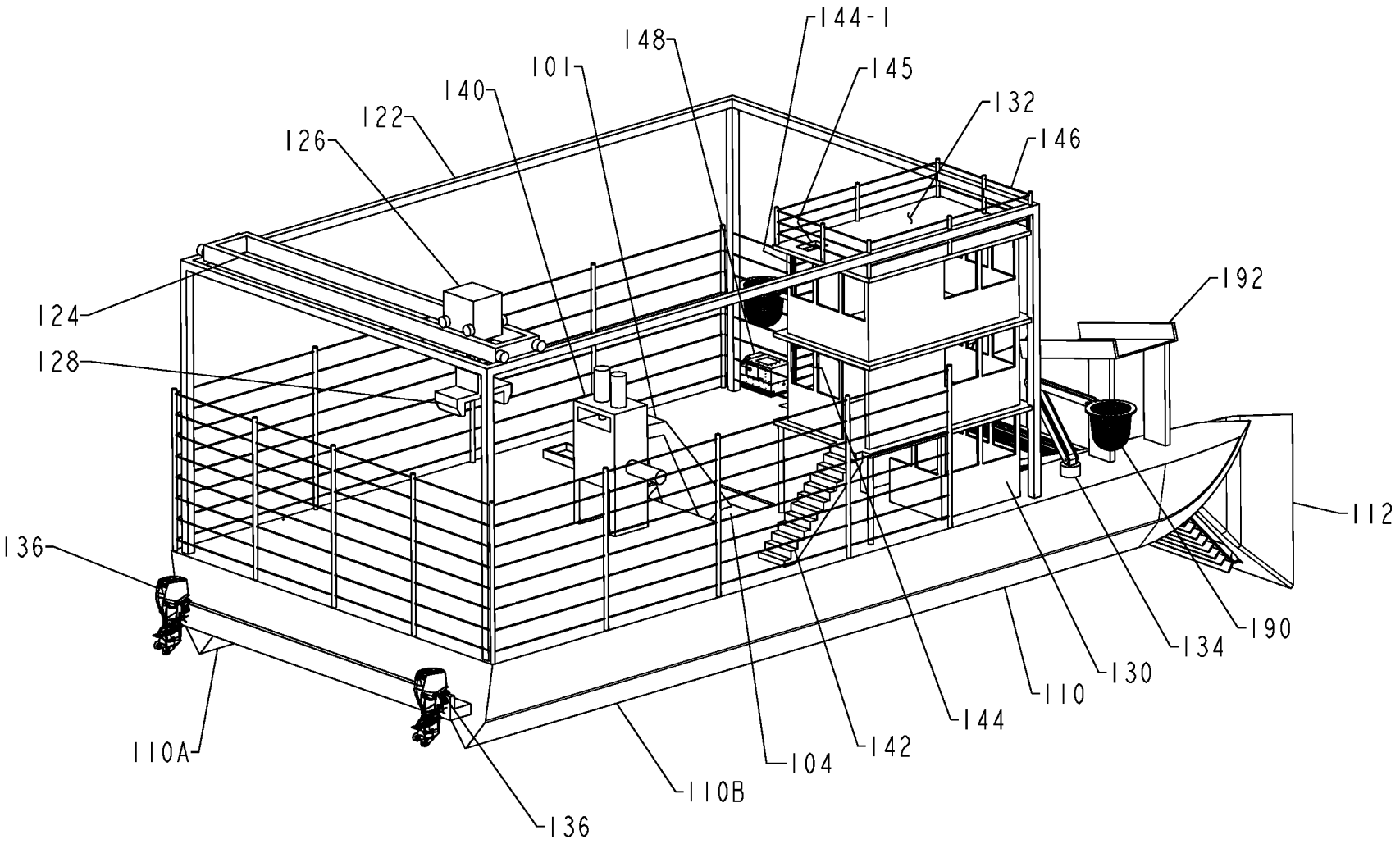
FIG. 4 is a perspective view illustrating the rear and right sides of the vessel of FIG. 1, according to an exemplary embodiment of the present invention.
Figure 5:
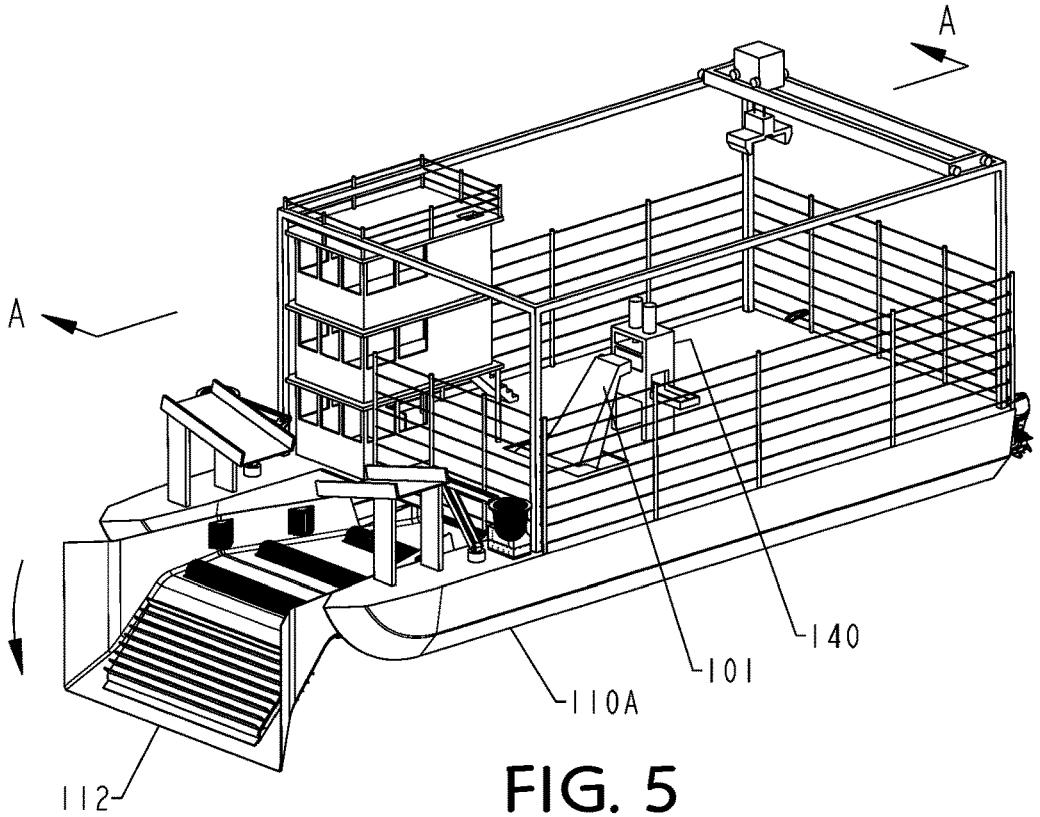
FIG. 5 is a perspective view illustrating the vessel of FIG. 1 with an intake funnel set to a lowered position.
Figure 6:
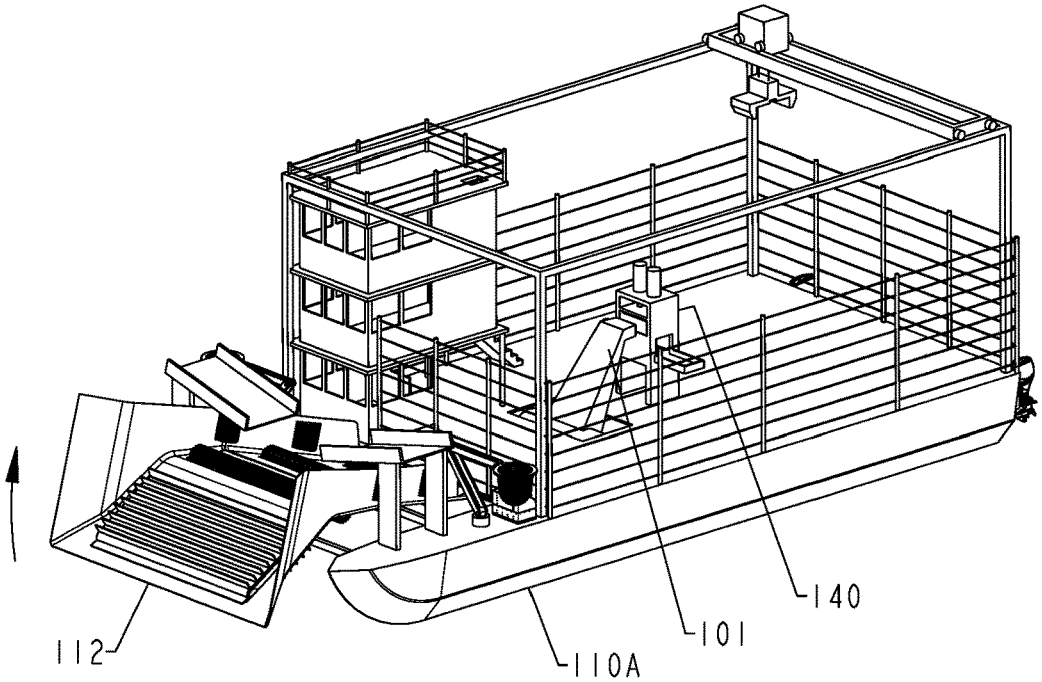
FIG. 6 is a perspective view illustrating the vessel of FIG. 1 with the intake funnel set to a raised position.

The funnel 112 may be pivotally coupled to the front portion of the vessel in order to be selectively set to a lowered position, as shown in FIGS. 1-5, 7 and 8, or to a raised position, as shown in FIG. 6. In the raised position, the funnel 112 may be positioned entirely above the waterline (see FIG. 7). When the funnel 112 is embodied as a claw, the claw may also be pivoted between a lowered position and a raised position as shown in FIGS. 5 and 6, similarly to the funnel 112.

The vessel of FIG. 1 may be navigated to and from the location of the trash 152 (see FIG. 7) with the funnel 112 in the raised position as shown in FIG. 6 for safety purposes and to reduce drag and fuel consumption.

The vessel of FIG. 1 may be operated to collect the trash 152 (see FIG. 7) with the funnel 112 set to lowered position as shown in FIGS. 1-5, 7 and 8.

When the funnel 112 is set to the lowered position, as shown in FIG. 7, the funnel 112 may extend at least partially below the waterline 150. Therefore, the funnel 112 is configured to capture trash 152 (see FIG. 7) suspended below the waterline 150 as well as trash 152 floating over the waterline 150.

Referring to FIGS. 1 and 7, the funnel 112 may include a conveyor 187 with paddles 188 for capturing the trash 152. The conveyor 187 may be, for example, similar to a conveyor belt, but with at least one paddle 188 disposed along its length. The conveyor 187 with paddles 188 is configured to rotate as shown by the arrows in FIG. 7 in order to capture and direct the trash 152 to the trash conveyor system (described below). From the viewpoint of FIG. 7, the conveyor 187 with paddles 188 is configured to rotate in the clockwise direction. The at least one paddle 188 may extend in a direction that crosses the direction in which the conveyor 187 extends. For example, as illustrated in FIG. 1, when the conveyor 187 extends generally along an X alignment (or X direction), the paddles 188 extend generally along a Y direction that crosses the X direction.

In FIG. 7 the conveyor 187 with paddles 188 is shown as being entirely submerged under water. However, the present invention is not limited thereto. In an embodiment, the conveyor 187 with paddles 188 extends at least partially over the waterline 150. For example, the conveyor 187 with paddles 188 may extend at least partially over the waterline 150 adjacent to a conveyor belt 109 (see FIGS. 1 and 7).

In an operating state, the conveyor 187 with paddles 188 may be inclined downwardly in a direction away from the vessel, as shown in FIGS. 1-5, 7 and 8. The conveyor 187 with paddles 188 may be perforated in order to reduce the risk of losing the captured trash 152 back into the water. For example, when the trash 152 is captured and transported inwardly by the conveyor 187 with paddles 188, the captured trash 152 releases some water since it is soaking wet. The released water can form one or more streams that flow over the conveyor 187 and over and alongside the paddles 188. The streams can cause the captured trash 152 to flow outwardly back into the water body. Since the conveyor 187 and/or the paddles 188 may be perforated, the streams are prevented from forming (or at least reduced) since the water released from the captured trash 152 will flow through the conveyor 187 and/or through the paddles 188. Therefore, the risk of releasing the captured trash 152 back into the water body is reduced due to the perforations of the conveyor 187 and/or the perforations of the paddles 188.

The conveyor 187 and the paddles 188 may be made of a metal and/or a polymer that has a high resistance to corrosion. For example, the conveyor 187 with paddles 188 may be made of stainless steel, aluminum, titanium, etc., and/or of polycarbonate, polyimide, nylon, polyester, etc.

Figure 2:
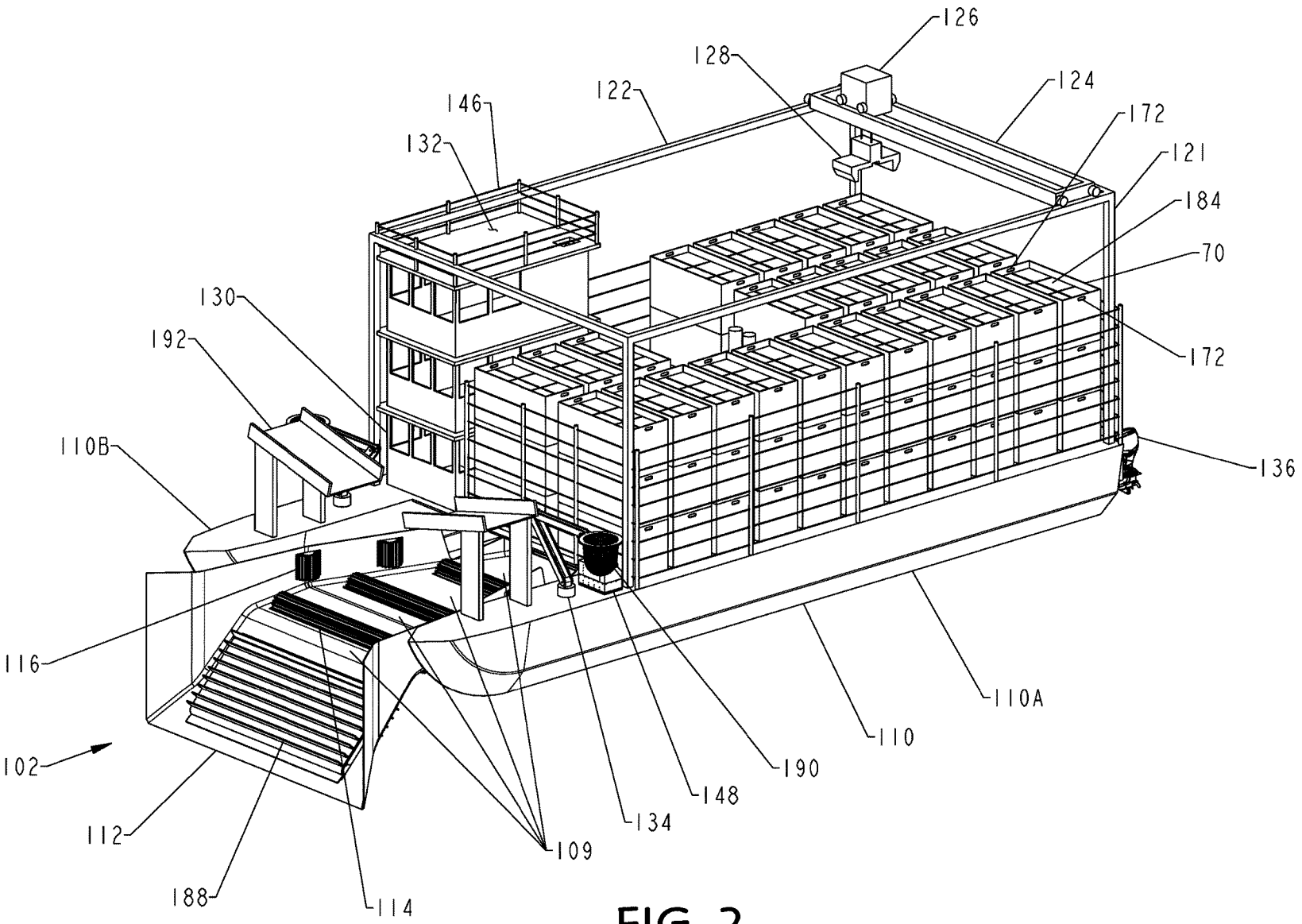
FIG. 2 is a perspective view illustrating the vessel of FIG. 1 in a loaded state, according to an exemplary embodiment of the present invention.

Referring to FIGS. 1, 2 and 7, the trash conveyor system may include a conveyor belt 109 extending between the conveyor 187 with paddles 188 and the trash processing portion 104. In addition, the trash conveyor system may include at least one paddle wheel 114 (see FIG. 1) disposed along a length of the conveyor belt 109 and at least one paddle wheel 116 (see FIG. 1) disposed between the conveyor 187 with paddles 188 and the trash processing portion 104.

Referring to FIG. 1, when the conveyor belt 109 extends in the X direction, the at least one paddle wheel 114 extends in the Y direction and the at least one paddle wheel 116 extends in a Z direction. As illustrated in FIG. 1, the X, Y and Z directions cross one another (e.g., are orthogonal to one another).

The conveyor belt 109 together with the paddle wheels 114 and 116 is configured to transport the captured trash 152 from the funnel 112 and/or the net/basket 190 (and/or the hook) of the at least one auxiliary crane 134 to the trash procession portion 104 of the vessel.

Since the trash 152 is captured from a body of water, the trash 152 is wet and may contain pockets or regions filled with water.

As shown in FIG. 7, the conveyor belt 109 may extend approximately at the waterline 150. However, the present invention is not limited thereto.

For example, the conveyor belt 109 may also extend at an elevation above the waterline 150. In this case, the conveyor belt 109 may be perforated in order to permit at least some of the water released by the trash 152 while being transported to the trash processing portion 104 to escape into the water body without forming streams over the conveyor belt 109 which could jeopardize the release of the captured trash 152 back into the water body. Therefore, the risk of releasing the captured trash 152 back into the water body while being transported on the conveyor belt 109 is reduced. In addition, due to the perforations of the conveyor belt 109, the captured trash 152 may have a low water content when arriving at the trash processing portion 104.

The reduction of water content from the trash 152 increases the operating efficiency of the trash processing portion 104 (e.g., the efficiency of shredding trash), and increases the efficiency in transporting the shredded trash 152 to the compactor 140. This, in turn increases the operating efficiency of the compactor 140 because the compactor 140 has less water to squeeze out of the shredded trash 152.

When the conveyor belt 109 is configured to extend above the waterline 150, the conveyor belt 109 may also be sloped downwardly (not shown) in a direction toward the trash processing portion 104. The downward slope of the conveyor belt 109 may further aid in preventing the captured trash 152 from sliding back toward the funnel 112 due to the tilting and/or rotation of the vessel caused by waves, wind, and/or other factors. Therefore, the downward slope of the conveyor belt 109 may prevent the release of captured trash 152 back into the water body. In addition, the links can have the same length as one another or different lengths.

The conveyor belt 109 may be made of the same material (s) as the conveyor 187 with paddles 188. The conveyor belt 109 can be formed of one elongated and flexible member (e.g., as one flexible belt) or as a plurality of links (e.g., belt sections) that are linked to one another. The plurality of links may be formed of flexible material and/or may be rotatably (e.g., hingedly) connected to one another.

Referring to FIGS. 1, 2 and 7, the trash conveyor system may include a plurality of paddle wheels 114 and a plurality of paddle wheels 116 configured to facilitate the process of transporting the captured trash 152 on the conveyor belt 109 toward the trash processing portion 104.

As shown in FIGS. 1 and 2, each of the paddle wheels 114 may extend substantially horizontally between the first and second hulls 110A and 110B. In addition, when the vessel is oriented as shown in FIGS. 1 and 6, each of the paddle wheels 114 may be configured to rotate in the clockwise direction, as shown by the curved arrow in front of the funnel 112 in FIG. 6. This is so to assist with conveying the captured trash 152 toward the trash processing portion 104. In addition, as shown in FIGS. 1 and 2, the paddle wheels 114 may be disposed at various locations along the length of the conveyor belt 109.

Referring to FIGS. 1-3, the plurality of paddles 116 may be alternatively arranged with the plurality of paddles 114. For example, as shown in FIGS. 1-3, the paddle wheels 116 may be arranged in pairs between two paddle wheels 114.

From among each pair of paddle wheels 116, one paddle wheel 116 may be disposed adjacent to the first hull 110A, as shown in FIG. 3, and the other paddle wheel 116 may be disposed adjacent to the second hull 110B, as shown in FIGS. 1-2.

Referring to FIGS. 1-3, the paddle wheels 116 may extend substantially vertically, and may be configured to rotate as shown by the curved arrow in FIG. 2 above of the two paddle wheels 116 disposed adjacent to the second hull 110B. It is understood that the paddle wheels 116 may also be configured to extend at an angle other than vertically. In other words, the paddle wheels 116 need not be plumb.

The paddle wheels 116 are also configured to rotate in a direction that assists the process of moving the captured trash 152 toward the trash processing portion 104. For example, the paddle wheels 116 may prevent the captured trash 152 from becoming stuck onto the sidewalls of the path which the trash 152 travels.

The paddle wheels 114 may prevent the captured trash 152 from jamming the operation of the conveyor belt 109 and/or to prevent the captured trash 152 from becoming stuck to the conveyor belt 109. In addition, the paddle wheels 114 may prevent the captured trash 152 from being released back into the water as a result of an unwanted wave entering from the funnel 112 and/or from any tilting of the vessel caused by waves, wind, current of water, etc., by virtue of their rotation.

The paddle wheels 114 and 116 may be perforated or un-perforated. In addition, the paddle wheels 114 may be made of the same materials as those described above for the conveyor 187 with paddles 188. In addition, the paddles of the paddle wheels 114 and 116 may be solid (e.g., rigid) or flexible.

As shown in FIGS. 1-6, the vessel may be equipped an auxiliary crane 134 and a trash chute 192 on each hull 110A and 110B. Each auxiliary crane 132 may have a first end connected to one of the hulls 110A and 110B, and a second end connected to a net/basket 190, as shown in FIGS. 1-6. In another embodiment, hooks might be used in place of, or in combination with, the net/basket 190.

As shown in FIG. 104, each auxiliary crane 134 may be composed of a plurality of elongated members which are rotatably coupled with respect to one another and with respect to the hull 110A and 110B such that the net/baskets 190 (and/or the hook) can be moved three-dimensionally in order to capture the trash 152 from the waterline 150 and/or the trash 152 that is submerged up to a certain depth below the waterline 150.

Each auxiliary crane 134 with its respective net/basket 190 (and/or hook) may be manually operated by an operator located in the vessel 110.

Referring to FIGS. 1-6, each trash chute 192 may be disposed at a predetermined distance from an auxiliary crane 134, and may include a chute, or ramp, sloped downwardly toward the conveyor belt 109.

Each auxiliary crane 134 may be operated to capture trash 152 from the water body through the net/basket 190 and/or hook, and to discharge the trash 152 captured by the net/basket 190 and/or hook onto the sloped ramp of the trash chute 192 such that the captured trash 152 can slide on the sloped ramp and fall from the sloped ramp onto the conveyor belt 109.

The vessel can be operated to capture trash by using only the funnel 112, only the auxiliary cranes 134, or both the funnel 112 and the auxiliary cranes 134. Therefore, the vessel may be operated efficiently to capture trash 152 that is located in front of the funnel 112 as well as trash 152 that is located adjacent to the sides of the vessel.

As shown in FIG. 7, the trash processing portion 104 is configured to receive the captured trash 152 from the conveyor belt 109 and to grind, shred, chip, rip, cut, or otherwise process the captured trash 152 into small pieces. The grinding, shredding, chipping, ripping, cutting, or other process used for turning the captured trash 152 into small pieces may be collectively referred to as "grinding."

As shown in FIG. 7, the trash processing portion 104 may include a structure (or housing) 105 with a trash receiving end 103, a trash output member 101, and a grinding drum 158 disposed between the receiving end 103 and the output member 101.

The grinding drum 158 may be configured to grind hard/strong/tough objects that make up the trash 152. The grinding drum 158 may be configured to grind trash 152 made of, for example, metal, wood, glass, etc., in addition to softer or less tough objects made of plastic, rubber, rope, etc. Therefore, the grinding drum 158 may be used to grind the trash 152 into small pieces regardless of the material that the trash 152 is made of.

Accordingly, the grinding drum 158 may be used for grinding trash 152 that includes, for example, metal containers, metal objects (e.g., chains or metal containers), metal or plastic buoys, wooden logs/pieces of wood, glass containers (e.g., glass bottles, etc.), plastic containers (e.g., plastic bottles, etc.), rope, fabric material, etc., as well as other types of trash that may be found floating or partially submerged under water.

The ground pieces of trash that are output by the grinding drum 158 are indicated in FIG. 7 by the reference numeral 154. The trash processing portion 104 may be configured to eject the ground trash 154 via the output member 101, as shown in FIG. 7.

Referring to FIG. 7, the ground trash 154 may be input to the compactor 140. For example, as shown in FIG. 7, the output member 101 of the trash processing portion 104 may be used to blow the ground trash 154 into the compactor 140.

As shown in FIGS. 1-7, the refuse intake portion 102 and the trash processing portion 104 may be disposed between the first and second hulls 110A and 110B of the vessel. However, the present invention is not limited thereto, and the refuse intake portion 102 and the trash processing portion 104 may be disposed at other locations of the vessel.

In addition, the refuse intake portion 102 and the trash processing portion 104 need not extend linearly, as shown in FIGS. 1 and 7.

Figure 12:
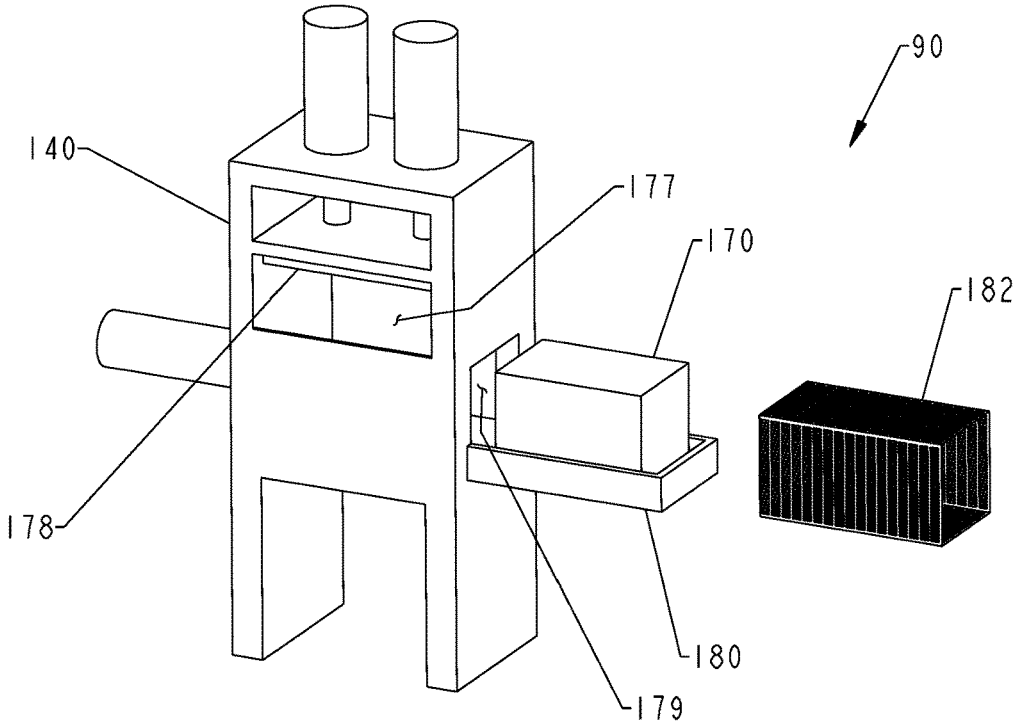
FIG. 12 is a perspective view illustrating a compactor configured to compact captured trash, according to an exemplary embodiment of the present invention.
Figure 13:
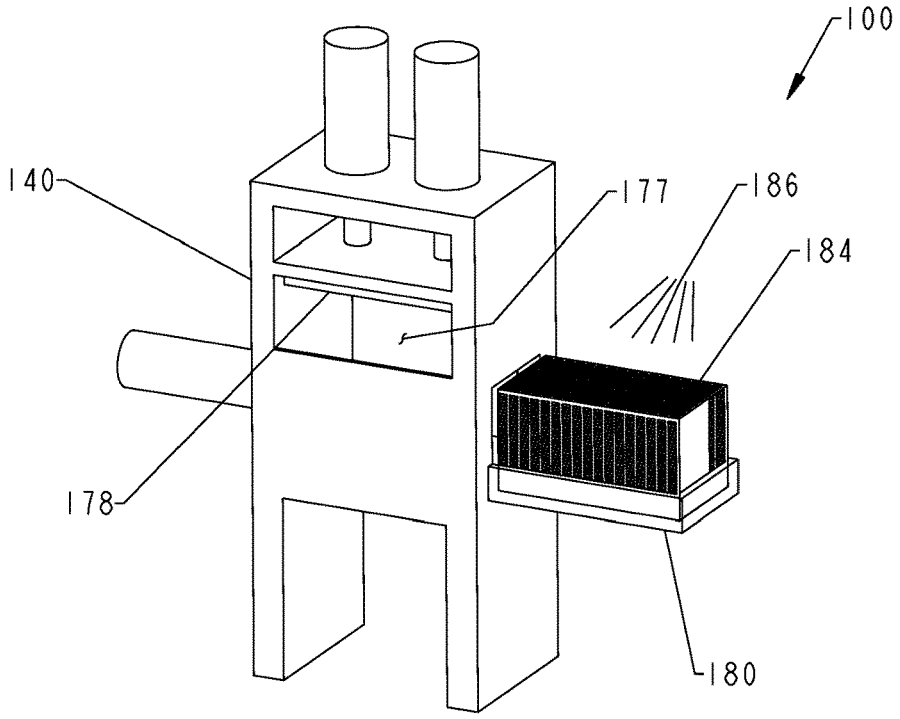
FIG. 13 is a perspective view illustrating the compactor of FIG. 12, according to an exemplary embodiment of the present invention.

Referring to FIGS. 107 and 12-13, the compactor 140 may be configured to compact the received ground trash 154 into a compacted mass of trash 170, as shown in FIG. 12.

The compactor 140 may be disposed, for example, on the cargo deck 108, as shown in FIG. 1. Referring to FIGS. 12 and 13, the compactor 140 may include an input opening 177 configured to receive the ground trash 154, a piston 178 configured to compact the received pieces of ground trash 154 into a mass of trash 170, an output opening 179 for outputting the compacted mass of trash 170, and an outfeed table 180 configured to support the output compacted mass of trash 170.

Referring to FIG. 12, an encapsulating member 182 may be used for encapsulating or for at least partially surrounding the compacted mass of trash 170 in order to prevent the compacted mass of trash 170 from crumbling since the compacted mass of trash 170 is a conglomerate of ground and compressed pieces of trash 154 which are not bound together by any binding substance (e.g., an adhesive).

Referring to FIG. 12, the encapsulating member 182 may be configured to extend along a plurality of sides of the compacted mass of trash 170. As shown in FIG. 12, the encapsulating member 182 may be configured to surround four sides of the compacted mass of trash 170, but the present invention is not limited thereto. For example, the encapsulating member 182 may also be configured to surround five sides or all of the sides of the compacted mass of trash 170.

The encapsulating member 182 may be configured to form a snug fit with the compacted mass of trash 170 in order to prevent the compacted mass of trash 170 from crumbling. For example, the encapsulating member 182 may be tensioned to apply a certain amount of compressive pressure to the compacted mass of trash 170 in order to prevent the compacted mass of trash 170 from crumbling.

When the compacted mass of trash 170 is ejected from the compactor 140 onto the outfeed table 180, the compacted mass of trash 170 may contain a certain amount of water inside since the ground pieces of trash 154 may be wet when fed into the compactor 140.

The encapsulating member 182 may be perforated in order to permit the compacted mass of trash 170 to leach out the water it contains. This is an important feature of the encapsulating member 182 because the leaching of the water reduces the weight of the compacted mass of trash 170. The reduction of weight of the compacted mass of trash 170 reduces the overall size and weight of each compacted mass of trash 170 carried by the vessel. This, in turn, reduces the amount of fuel spent to navigate the vessel and improves the maneuverability of the vessel due to the reduced weight.

The encapsulating member 182 may be flexible and/or elastomeric. Since the compacted mass of trash 170 may decrease in size (e.g., contract) when leaching water, the encapsulating member 182 may also contract around the compacted mass of trash 170 due to the flexibility/elastomeric property of the encapsulating member 182. Therefore, the encapsulating member 182 may conform to the reduced size of the compacted mass of trash 170 and may maintain the compacted mass of trash 170 in compression in order to prevent crumbling even when the compacted mass of trash 170 contracts due to the leaching of water.

Although not shown in the drawings, the compactor 140 may be configured to perform the task of covering the compacted mass of trash 170 with the encapsulating member 182. For example, when the encapsulating member 182 is configured to cover four or five sides of the compacted mass of trash 170, the compactor 140 may be configured to insert the compacted mass of trash 170 inside of the encapsulating member 182 or to wrap the encapsulating member 182 around the compacted mass of trash 170.

In addition, the compactor 140 may be configured to cover (e.g., wrap around) all of the sides of the compacted mass of trash 170 with the encapsulating member 182.

Alternatively, another device (not shown) may be used to cover/encapsulate the compacted mass of trash 170 with the encapsulating member 182.

The encapsulating member 182 may be made of a flexible and/or elastomeric material that has a high resistance to tensile stress. For example, the encapsulating member 182 may be made of nylon, polyester, polyamide, etc. Merely as an example, the encapsulating member 182 may be made of fabric that includes nylon or polyester fibers.

For example, the encapsulating member 182 may include a sheet of fabric which includes nylon, polyester, polyamide, etc., fibers. Such sheet of fabric may be perforated prior to being wrapped around the compacted mass of trash 170, or may be perforated after being wrapped around the compacted mass of trash 170.

Alternatively, on in addition, the encapsulating member 182 may include a mesh, for example a metallic mesh, that allows the water to leach out of the compacted mass of trash 170 while contracting together with the compacted mass of trash 170 in order to maintain compression pressure on the compacted mass of trash 170 while the compacted mass of trash 170 leaches water. This may prevent the compacted mass of trash 170 from crumbling while the compacted mass of trash 170 is being moved and stored within the vessel, and in transportation from the vessel to its ultimate recycling or storage destination.

When the encapsulating member 182 includes a metallic mesh, the metallic mesh may be made of, for example, stainless steel.

The perforations and/or mesh openings of the encapsulating member 182 may be small in size in order to avoid releasing outwardly any of the pieces of ground trash 154 that are contained in the compacted mass of trash 170.

In an embodiment, the encapsulating member 182 may be made of shrink wrap. The shrink wrap may be formed of one or more sheets of plastic/elastomeric material. For example, the shrink wrap may be made of plastic film. The shrink wrap may be made of, for example, polyvinyl chloride (PVC), polyolefin, polyethylene (PE), polypropylene, etc. Alternatively, the shrink wrap may be formed of un-perforated sheets of plastic/elastomeric material, and the shrink wrap may be perforated after being wrapped around the compacted mass of trash 170.

When the encapsulating member 182 is made of shrink wrap, the shrink wrap may be disposed on a plurality of sides (including all the sides) of the compacted mass of trash 170. In this case, the vessel may include a heat source, for example, a heat gun (not shown) in order to apply heat (the heat is indicated by reference numeral 186 on FIG. 13) to the shrink wrap film in order to shrink the film. The shrinking of the film enables the shrink wrap to secure the compacted mass of trash 170 within the shrink wrap and to prevent the compacted mass of trash 170 from releasing outwardly any individual pieces of ground trash 154. The shrink wrap film may be perforated, or may be un-perforated. When the shrink wrap is provided as un-perforated film, the shrink wrap may be perforated after it is used to encapsulate a compacted mass of trash 170. The perforation process may be performed manually by a crew member or automatically by the compactor 140.

Figure 9:
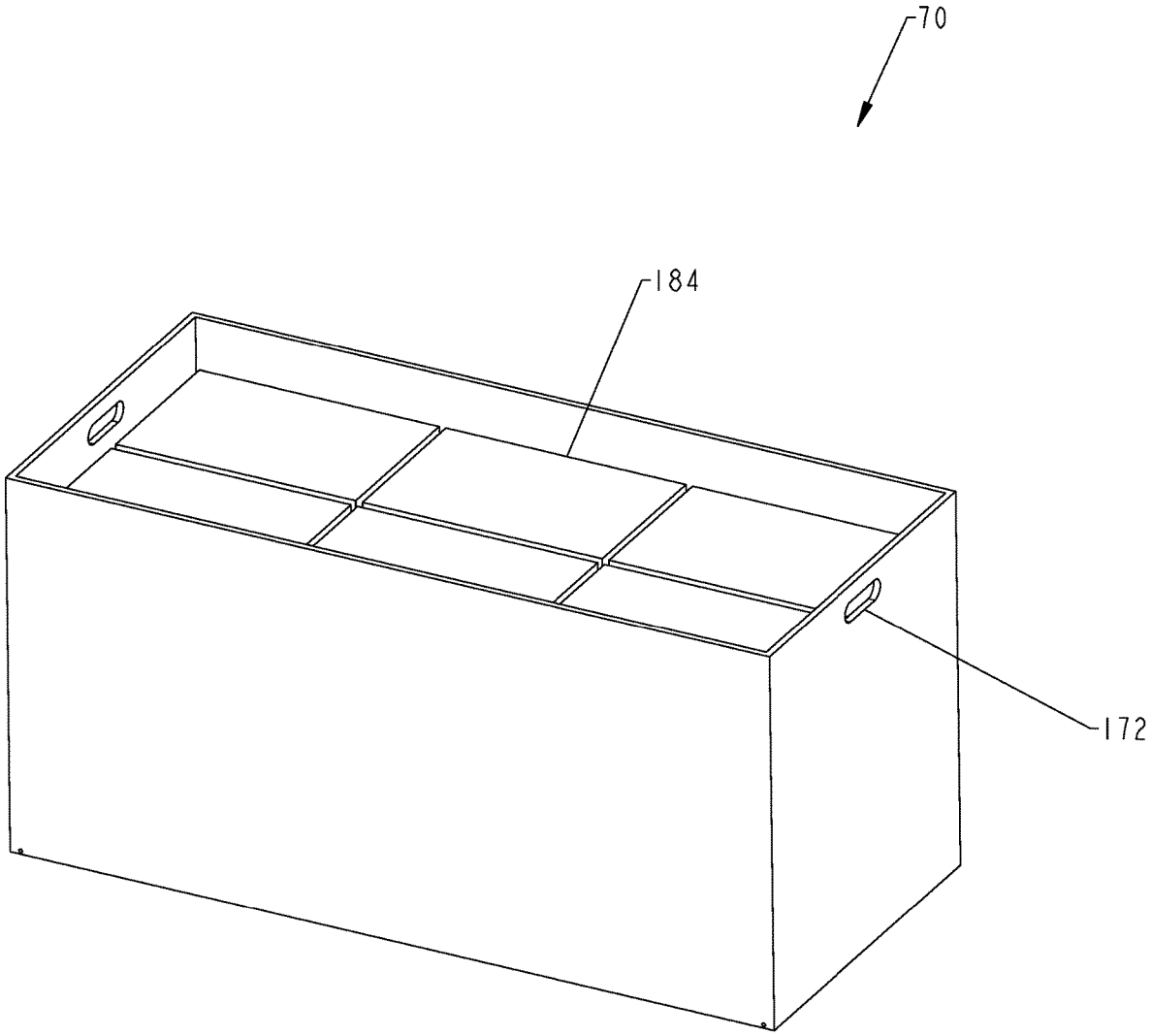
FIG. 9 is a perspective view illustrating the top and sides of a trash container, according to an exemplary embodiment of the present invention.
Figure 10:
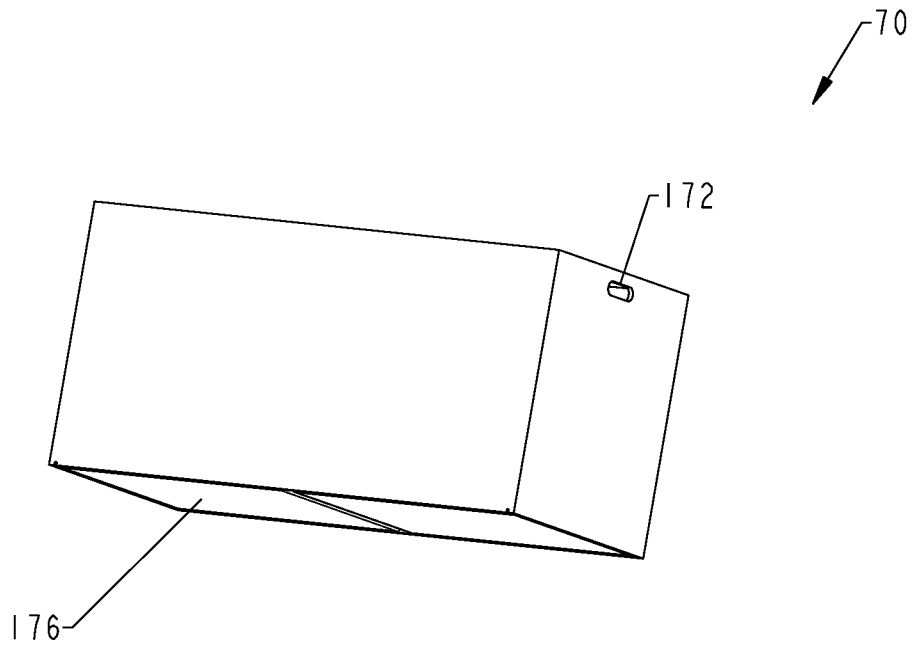
FIG. 10 is a perspective view illustrating the bottom and sides of a trash container in a closed state, according to an exemplary embodiment of the present invention.
Figure 11:
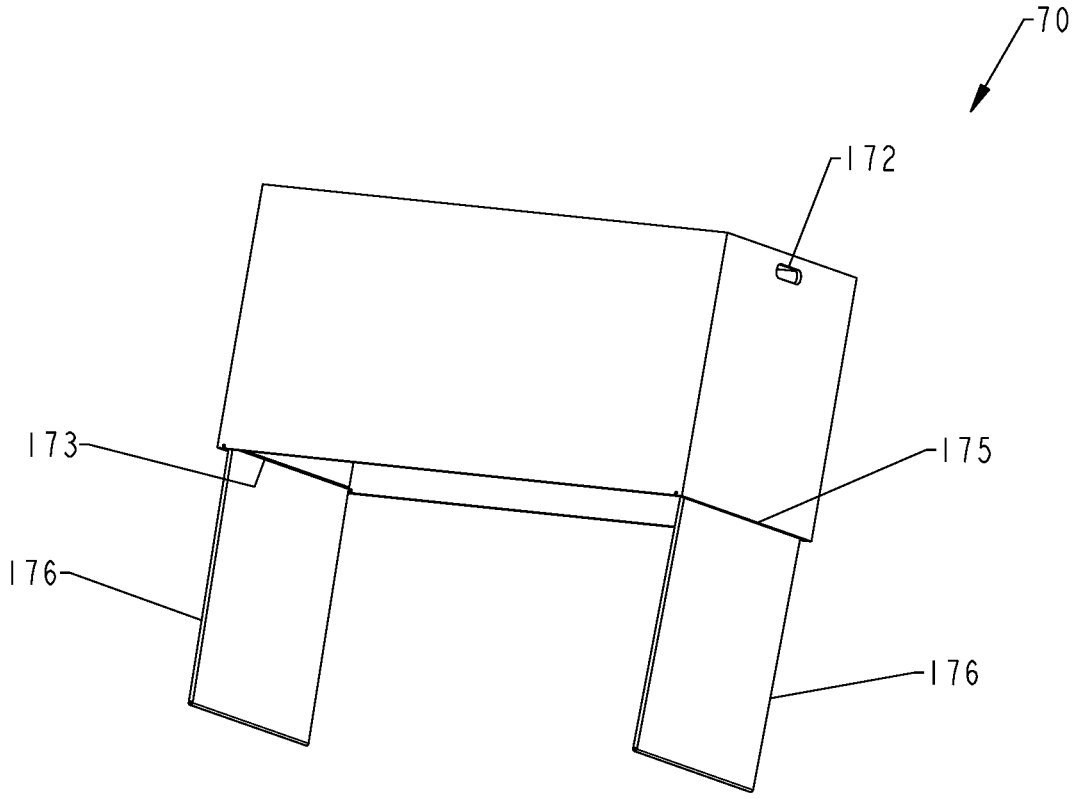
FIG. 11 is a perspective view illustrating the bottom of the trash container of FIG. 10 in an opened state, according to an exemplary embodiment of the present invention.

FIGS. 9-11 illustrate a trash container that may be loaded with the compacted mass of trash 170 covered by the encapsulating member 182. A compacted mass of trash 170 that is covered by an encapsulating member 182 may be referred to as encapsulated trash mass 184. An example of an encapsulated trash mass 184 is shown in FIG. 13.

The trash container may be configured to accommodate at least one encapsulated trash mass 184 inside. In an embodiment, the trash container 70 is configured to accommodate a plurality of encapsulated masses of trash 184 inside. For example, referring to FIG. 9, the trash container 70 may be configured to accommodate six encapsulated masses of trash 184 inside.

As illustrated in FIGS. 2 and 9, each trash container 70 may have an open top in order to receive the one or more encapsulated masses of trash 184 inside. Merely as an example, the trash containers 70 illustrated in FIG. 2 are configured to accommodate six encapsulated masses of trash 184 inside.

Referring to FIGS. 2 and 9-11, each trash container 70 may include an open top, a plurality of sides, and a plurality of bottom portions 176. Referring to FIGS. 10 and 11, the bottom portions 176 are respectively pivotally coupled to edges 173 and 175 of the trash container 70 such that the bottom portions 176 can be pivoted as desired between an open state, as shown in FIG. 11, and a closed state, as shown in FIG. 10, in order to open and close the bottom of the trash container 70.

This is advantageous because the opening of the bottom portions 176 allows the encapsulated masses of trash 184 to be unloaded onto the cargo ship 160 (see FIG. 8) without having to store the trash container 70 onto or inside of the cargo ship 160. Thus, the cargo ship 160 may pick up each loaded trash container 70 from the vessel by using a crane (e.g., a crane mounted on the cargo ship 160), and the cargo ship 160 may use the crane to selectively open the bottom portions 176 of each loaded trash container 70 at a desired trash storage location of the cargo ship 160. Therefore, the cargo ship 160 may receive only the encapsulated masses of trash 184, and not the trash containers 70. Thus, the process of manually emptying the loaded trash containers 70 onto/inside of the cargo ship 160 is avoided.

The avoidance of the unnecessary process of emptying of the loaded trash containers 70 onto/inside of the cargo ship 160 reduces labor costs, increases the operating efficiency of the cargo ship 160, and permits a large number of encapsulated masses of trash 184 to be dumped from the cargo ship 160 to a permanent (or transient) trash disposal facility while preventing the trash containers 70 from being wasted. Alternatively, in the case when the trash containers 70 would be dumped on the cargo ship 160 together with the encapsulated masses of trash 184, and from the cargo ship 160 to the trash disposal facility, (in order to conserve the labor needed to unload the trash container 70 on the cargo ship 160), the dumping of the trash containers 70 in the trash disposal facility would result in added waste and a high operating cost due to the need to constantly purchase new trash containers 70. This may be prevented by using the bottom portions 176 to unload the encapsulated masses of trash 184 from the trash container 70 onto/inside of the cargo ship 160, and returning the unloaded trash container 70 back to the vessel. Accordingly, the trash container 70 may be reused on the vessel to store additional captured trash.

The bottom portions 176 of each trash container 70 may be manually opened and closed as needed, for example, via a manual lever (not shown) included in each trash container 70. Alternatively, or in addition, the bottom portions 176 of each trash container 70 may be opened and closed via a remote-control signal. In the case of the remote-control signal, each trash container 70 may be provided with a wireless receiver, a controller circuit, and a motor/actuator that is configured to selectively open and close the bottom portions 176 in response to an opening signal or a closing signal. The opening signal may be emitted by, for example, an operator of the cargo ship 160. The opening signal may be received by the receiver of a particular trash container 70 that is being unloaded onto/inside of the cargo ship 160. The processor of that trash container 70 may recognize the received opening signal and may control the motor or actuator to open the bottom portions 176 in order to unload the encapsulated masses of trash 184 at a desired location onto/inside the cargo ship 160. After unloading the encapsulated masses of trash 184, an operator of the cargo sip 160 may send a close signal to the unloaded trash container 70 in order to close the bottom portions 176. The unloaded trash container 70 may be returned to the vessel such in such that the vessel may use the unloaded trash container 70 again for storing new/additional encapsulated masses of trash 184. This process eliminates the need for storing additional empty trash containers 70 into/onto the cargo ship 160 for resupplying the vessel with empty trash containers 70.

As shown in FIGS. 2 and 10-11, each trash container 70 may include a pair of handles 172 formed in opposing sidewalls of the trash container 70. Each handle 172 may be, for example, an opening formed in the sidewall of the trash container 70. The handles 172 may be used for lifting/transporting the trash container 70 in a loaded and unloaded state.

Referring back to FIGS. 12 and 13, the compactor 140 may be configured to load an encapsulated mass of trash 184 in one of the trash container 70 located on the cargo deck 108, as shown in FIG. 2. For example, an empty or partially filled trash container 70 may be disposed on cargo deck 108 below or under the outfeed table 180 of the compactor 140 in order to load the trash container 70 with the encapsulated mass of trash 184 that is disposed on the outfeed table 180.

In this case, the compactor 140 may have a mechanism (not shown) for loading the encapsulated mass of trash 184 inside of the trash container 70. For example, the compactor 140 may have a mechanical arm (not shown) attached thereto which is configured to push the encapsulated mass of trash 184 off of the outfeed table 180 such that the encapsulated mass of trash 184 can fall by virtue of gravity into the trash container 70. Alternatively, or in addition, outfeed table 180 may be rotatably coupled to the compactor 140 such that when the outfeed table 180 is rotated, for example, with respect to the horizontal axis, the encapsulated mass of trash 184 can fall by virtue of gravity into the trash container 70.

In addition, a gantry crane 126 (see, e.g., FIG. 1) can be used for the purpose of gripping the encapsulated mass of trash 184 from the outfeed table 180 and placing the gripped encapsulated mass of trash 184 inside of the trash container 70. The gantry crane 126 can be configured to operate automatically when it detects an encapsulated mass of trash 184 on the outfeed table 180 and an available trash container 70 disposed near the outfeed table 180. Alternatively, or in addition, the gantry crane 126 can be operated manually to pick up, move and release an encapsulated mass of trash 184 inside of a trash container 70 or on another location within the vessel. Alternatively, or in addition, a robotic arm can be used to grip the encapsulated mass of trash 184 from the outfeed table 180 and place the gripped encapsulated mass of trash 184 inside of the trash container 70. This can be done automatically, for example, when the robotic arm detects an encapsulated mass of trash 184 on the outfeed table 180 and an available trash container 70 disposed near the outfeed table 180, or it can be performed manually by an operator of the robotic arm. The robotic arm can also be used to move the containers 70—whether loaded or unloaded with encapusulated masses of trash 184—to different locations on the cargo deck 108 and/or in an interior storage chamber of the vessel. The robotic arm can be used instead of the gantry crane 126, in conjunction with the crane 126, or instead of the crane 126 to move encapsulated masses of trash 184 and/or containers 70 within the vessel.

Referring back to FIG. 1, the cargo deck 108 is shown in FIG. 1 as being empty for convenience of illustration. In FIG. 2, the cargo deck 108 is shown as being fully loaded with trash containers 70.

In FIG. 2, the trash containers 70 are illustrated as being fully loaded with encapsulated masses of trash 184.

However, when the vessel of FIGS. 1-8 is in an unloaded state as shown in FIG. 1, the cargo deck is preferably loaded with empty trash containers 70 such that the empty trash containers 70 can be filled with trash 152 as described above. The empty trash containers 70 can be arranged and stacked on one another, for example, similarly to the loaded trash containers 70 illustrated in FIG. 2.

As described above, the system 106—and more specifically, the gantry crane 126—can be used for moving individual encapsulated masses of trash 184 from the outfeed table 180 into the empty trash containers 70. In addition, the system 106 of the vessel illustrated in FIGS. 1-8 may be used for allocating the trash containers 70 within the vessel. For example, the system 106 may be used to sequentially retrieve each of the trash containers 70 from their respective storage locations on the cargo deck 108, to place each retrieved trash container 70 adjacent to or near the compactor 140 such that each empty trash container 70 can be filled with the encapsulated masses of trash 184 as described above, and to pick up and store each filled trash container 70 into an appropriate location on the cargo deck 108 or into another area of the vessel (e.g., in an internal storage chamber).

The system 106 may include a plurality of first members 121 (see FIG. 1), a plurality of second members 122 (see FIG. 1) connected to the first members 121, the gantry frame 124 (see FIG. 1) slidably engaged with the second members 122, and a gantry crane 126 slidably engaged with the gantry frame 124. These components (e.g., the first and second members 121 and 122, the gantry frame 124 and the gantry crane 126) are utilized for the purpose of allocating a compacted mass of trash onboard the vessel.

Referring to FIG. 1, the first members 121 may be disposed along an outer perimeter of the cargo deck 108 and may extend upwardly (e.g., along a Z alignment or Z direction as shown in FIG. 1) from the cargo deck 108. Each of the second members 122 may extend between a pair of the first members 121 at the top end thereof.

Referring to FIG. 1, the gantry frame 124 may be supported by a pair of second members 122. In addition, the gantry fame 124 may be configured to move bidirectionally on the pair of second members 122 along an X alignment (or X direction), see FIG. 1.

Referring to FIG. 1, the gantry crane 126 may be configured to move bidirectionally on the gantry frame 124 along a Y alignment. The Y alignment may intersect (e.g., cross) the X alignment. In other words, the gantry crane 126 can be moved relative to the gantry frame 124 along the Y direction. Since the gantry frame 124 can be moved bidirectionally along the X direction and the gantry crane 126 can be moved bidirectionally along the Y direction relative to the gantry frame 124, the gantry crane 126 can be moved along a plane formed by the X and Y directions over the cargo deck 108.

Referring to FIG. 1, the gantry crane 126 may include a member 128 configured to be selectively attached to the trash containers 70. The gantry crane 126 may be configured to raise and lower the member 128 with respect to the cargo deck 108 via at least one cable 127 (see FIG. 1).

The member 128 may be, for example, a claw, as shown in FIG. 1. The claw may be used to selectively clamp and unclamp the trash containers 70 for relocating/moving the trash containers 70 on the cargo deck 108. For example, the claw may be selectively engageable with the openings which form the handles 172 on the trash containers 70, or with other portions of the trash containers 70.

Alternatively, the member 128 may include a plurality of hooks configured to selectively hook and unhook the trash containers 70 through, for example, the openings which form the handles 172.

Since the gantry frame 124 is mobile about the length of the second members 122, since the gantry crane 126 is mobile about the length of the gantry frame 124, and since the member 128 can be raised and lowered with respect to the surface of the cargo deck 108, the member 128 of the gantry crane 126 may be mobile in three dimensions over the entire surface of the cargo deck 108 in order to relocate/transport the empty and loaded trash containers 70 where and when needed on the cargo deck 108 or in other locations within the vessel. For example, the gantry crane 126 may be used to stack the trash containers 70 on one another, as shown in FIG. 2.

The gantry crane 126 may be configured to be operated automatically via a computer loaded with a program containing instructions for operating the gantry crane 126. In addition, or alternatively, the gantry crane 126 may be manually operated by a user located within the vessel.

The gantry crane 126 include an accelerometer, a gyroscope and an inertial measurement unit (IMU) for determining the actual location of the trash container 70 that is picked up by the member 128 above the surface of the cargo deck 108 in real time while the trash container 70 swings to a certain degree due to the waves, wind, and other environmental factors affecting the vessel of FIGS. 1-8. Therefore, the trash container 70 that is picked up by the gantry crane 26 may be unloaded at a precise desired location on the cargo deck 108 when desired while the vessel may be traveling, rocking, turning, etc. This may include stacking the trash container 70 that is picked up by the gantry crane 126 over another trash container 70 on the cargo deck 108 while the vessel is in motion and/or affected by wind, waves, choppy water, turbulent water, etc.

Accordingly, the gantry crane 126 can be operated even the vessel is traveling and/or is subjected windy conditions, waves, choppy or turbulent or water.

As illustrated in FIG. 1, the vessel may include a plurality of safety poles 118 disposed around the perimeter of the cargo deck 108, and a plurality of safety cables/rails 120 surrounding the cargo deck 108 in order to prevent the crew and the trash containers 70 from accidentally falling into the water. The safety poles 118 may have a hollow cross-section in order to be light weight. Therefore, the combination of the safety poles 118 with the safety cables/rails 120 provides a lightweight solution for preventing the crew and the trash containers 70 of the vessel from accidentally falling into the water.

Referring to FIG. 1, the wheelhouse and quarters 130 may be configured to house the crew of the vessel of FIGS. 1-8, including the captain. In addition, the wheelhouse and quarters 130 may include a plurality of stories with windows extending at least partially on each sidewall of each story such that certain portions of the vessel, for example, the cargo deck 108, the compactor 140, the refuse intake portion 102, the conveyor belt 109, the at least one auxiliary crane 134, the at least one trash chute 192, the generator 148, etc., can be visible from inside of the wheelhouse and quarters 130.

In addition, the windows of the wheelhouse and quarters 130 enable the captain to navigate the vessel and to assess the weather condition.

A top of the wheelhouse and quarters 130 may include a lookout platform 132 (see FIG. 1) with a safety railing 146 (see FIG. 1) extending all around the lookout platform 132.

As shown in FIG. 3, the vessel of FIGS. 1-8 may include a staircase 142 for providing access between the cargo deck 108 and an intermediate level (e.g., the second story) of the wheelhouse and quarters 130.

As shown in FIGS. 3-4, the wheelhouse and quarters 130 may include a ladder 144 for connecting the intermediate levels (e.g., the second and third stories) of the wheelhouse and quarters 130 to one another. Alternatively, or in addition, the wheelhouse and quarters 130 may include an internal staircase (not shown) for connecting the intermediate levels of the wheelhouse and quarters 130 with one another.

Referring to FIGS. 3-4, the wheelhouse and quarters 130 may include a ladder 144-1 for providing access from the uppermost story of the wheelhouse and quarters 130 to the lookout platform 132. Alternatively, or in addition, the wheelhouse and quarters 130 may include an internal staircase (not shown) for connecting the uppermost story of the wheelhouse and quarters 130 with the lookout platform 132.

Referring to FIGS. 1 and 4, the wheelhouse and quarters 130 may include a roof access point 145 located away from the outer periphery of the vessel for safety purposes.

Referring to FIG. 1 the generator 148 may be the main generator used for powering the vessel of FIGS. 1-8 with electricity, or the generator 148 may be an auxiliary generator used for emergency purposes (e.g., when the main generator of the vessel fails).

Although a vessel of the present invention is exemplary illustrated with reference to FIGS. 1-8, it is understood that the present invention is not limited to the configuration of the vessel described above with reference to FIGS. 1-8.

A vessel of the present invention may be embodied as any vessel with two or more hulls, for example, a catamaran with two hulls, a pontoon with at least two hulls, or a vessel with a flat bottom.

When the vessel is embodied as a pontoon, for example, a pontoon with three hulls, the funnel 102 may be disposed in front of the vessel. Alternatively, or in addition, the pontoon may include a plurality of funnels 102 with each funnel 102 disposed between a pair of adjacent hulls (when the pontoon includes three or more hulls). When the pontoon includes a plurality of funnels 102, the pontoon may also include a conveyor belt 109 associated with each of the funnels 102, and each of the conveyor belts 109 may converge at the trash processing portion 104.

When the vessel of the present invention is embodied as a vessel with a flat bottom, the vessel may include at least one funnel 102 disposed at a front portion of the vessel.

In addition, although not illustrated in the drawings, a vessel of the present invention may also include an additional funnel 102 disposed at each side of the vessel in addition to the funnel 102 that is disposed at the front of the vessel.

Since a vessel of the present invention may be configured to collect trash that may be located adjacent to a plurality of sides of the vessel, the vessel may be efficient at cleaning up a water body contaminated with floating and submerged trash.

A vessel of the present invention may be used to clean trash from a plurality of different types of water bodies. For example, a vessel of the present invention may be used to collect trash from one of the oceans or seas, which are composed of saltwater, or from a lake, pond or river, which may be composed of freshwater or saltwater.

Importantly, a vessel of the present invention may include a plurality of hulls for stability in the ocean on in other large water bodies. Such configuration provides the stability needed when collecting trash from the water surface and to a certain depth below the water surface by using the funnel. In other words, the configuration of the vessel with a plurality of hulls greatly reduces the rotation of the vessel about its longitudinal axis, which in turn reduces the rocking/rotation of the funnel about the longitudinal axis of the vessel during the trash collection process.

The low degree of rotation of the vessel about its longitudinal axis also reduces the swinging of the member 128 of the gantry crane 126, which further increases the efficiency of operation of the trash collecting, compacting and storage system on the vessel. For example, since the member 128 of the gantry crane 126 may swing to a lesser extent while loaded with a trash container 70, less time is needed to wait for the trash container 70 to swing over its intended disposal location on the cargo deck 108 before being unloaded. The unloading process of the trash container 70 may be calculated by using the accelerometer, a gyroscope and IMU, as described above.

Figure 14:
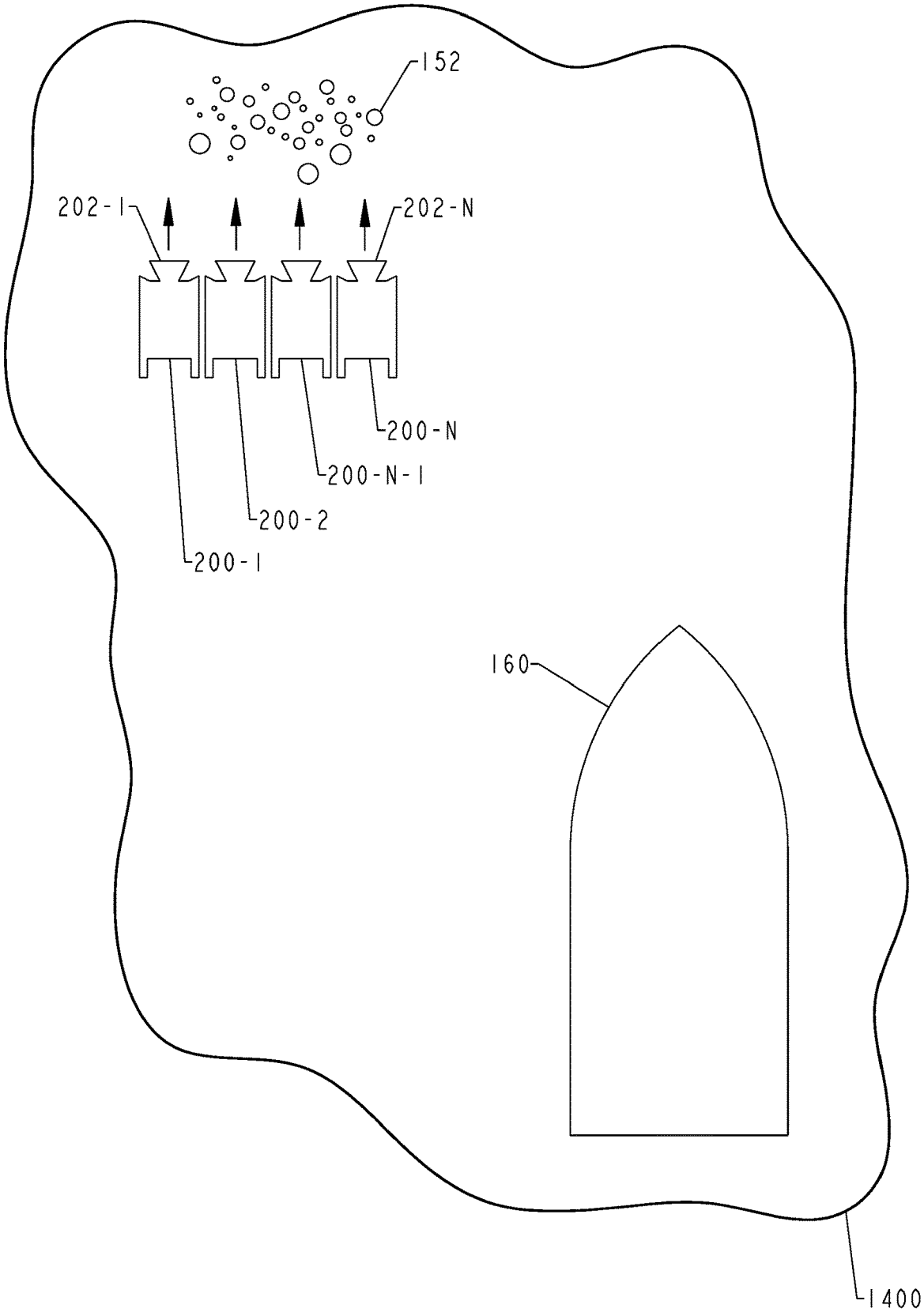
FIG. 14 is a plan view illustrating a system of vessels configured to remove refuse from a water body, according to an exemplary embodiment of the present invention.

FIG. 14 illustrates a system for cleaning trash from a water body. Referring to FIG. 14, the system may include a plurality of vessels 200-1 to 200-N, with N being a positive nonzero integer, and a cargo ship 160. The vessels 200-1 to 200-N may be traveling on a water body 1400 toward a patch of trash 152. Each of the vessels 200-1 to 200N may be configured as the vessel described above with reference to FIGS. 1-8, or the vessel described as having a three or more hulls, or a flat bottom.

Therefore, each of the vessels 200-1 to 200-N may include a respective funnel 202-1 to 202-N, as shown in FIG. 14. The plurality of vessels 200-1 to 200-N, may be sent as a group such that the vessels 200-1 to 200-N may, as a group, clean a large patch of trash 152 from the water body 1400.

In order to clean the large patch of trash 152 illustrated in FIG. 14, the vessels 200-1 to 200-N may be arranged in a straight formation (e.g., arranged in a row as shown in FIG. 14), or in a chevron or half chevron formation (not shown), and may travel toward a large patch of trash 152 as illustrated by the arrows in FIG. 14.

Each of the vessels 200-1 to 200-N may include bumpers (e.g., rubber bumpers, rubber tires, etc.,) disposed on each of its side surfaces in order to avoid being damaged and/or causing damage to the other vessels, from among the vessels 200-1 to 200-N, and/or the ship 160 while in operation.

Figure 8:
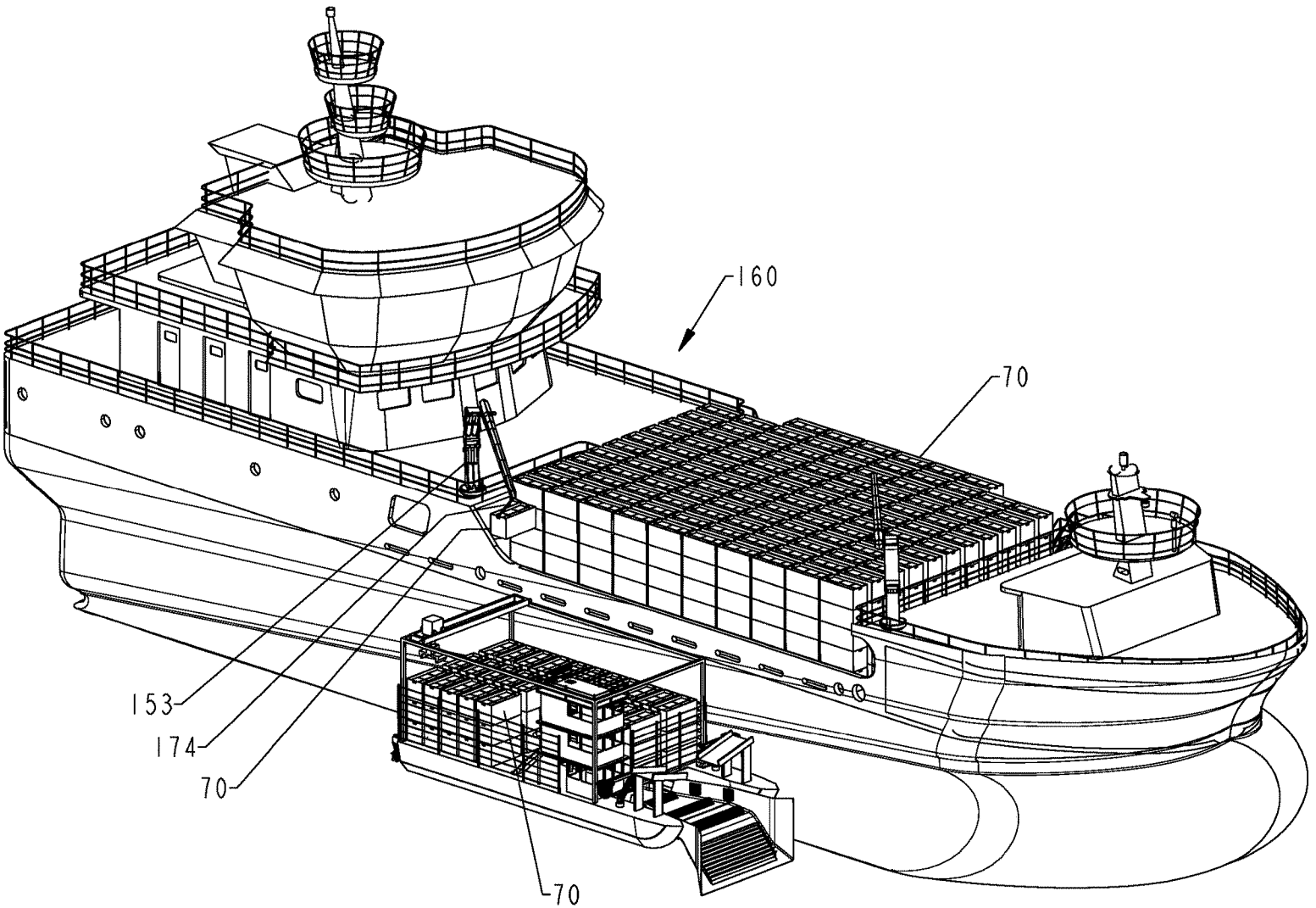
FIG. 8 is a perspective view illustrating the vessel of FIG. 1 alongside a larger vessel for the purpose of loading/unloading trash containers to/from the larger vessel.

As shown in FIGS. 8 and 14, each of the vessels 200-1 to 200-N may be dispatched toward a large patch of trash 152 (see FIG. 14 illustrating arrows with direction of travel), with the cargo ship 160 remaining within a maximum predefined distance from the vessels 200-1 to 200-N. The cargo ship 160 may be larger than the vessels 200-1 to 200-N and may be used for storing a plurality of empty and/or full trash containers 70. In addition, the cargo ship 160 may be loaded with fuel for refueling the vessels 200-1 to 200-N as needed on the open water.

As shown in FIG. 8, the cargo ship 160 may include a crane 153 for transferring the plurality of trash containers 70 from the ship 160 onto each of the vessels 200-1 to 200-N, and for transferring the filled, partially filled, and/or unfilled trash containers 70 from each of the vessels 200-1 to 200-N to the cargo ship 160. The crane 153 may utilize a hoisting strap 174 (see FIG. 8) for picking up the trash containers 70, or may utilize a hook (not shown) or other mechanism for selectively attaching the containers 70 to the crane 153.

Thus, the cargo ship 160 may be used for loading empty trash containers 70 to each of the vessels 200-1 to 200-N prior to dispatching the vessels 200-1 to 200-N for collecting the trash 152 from the water body 1400. Alternatively, the vessels 200-1 to 200-N may be loaded with empty trash containers 70 at the loading dock (not shown).

The crew and captain of the cargo ship 160 may be communicatively connected to the captain and crew of each of the vessels 200-1 to 200-N such that the transferring of the trash containers 70 between the cargo ship 160 and each of the vessels 200-1 to 200-N may be performed in an orderly and coordinated fashion. For example, the cargo ship 160 may be used to sequentially load the vessels 200-1 to 200-N with empty trash containers 70.

After being loaded with empty trash containers 70, the vessels 200-1 to 200-N may be dispatched to collect the trash 152 on the water body 1400, as exemplarily illustrated in FIG. 14.

Following the successful collection of trash 152, each of the vessels 200-1 to 200-N may navigate adjacent to the cargo ship 160, as shown in FIG. 8, in order for the cargo ship 160 to pick up and transfer each of the filled, partially filled, and/or unfilled trash containers 70 from the vessel onto and/or inside the cargo ship 160 by using the crane 153. The vessels 200-1 to 200-N may be sequentially loaded and/or unloaded from the cargo ship 160.

Each individual vessel from among the vessels 200-1 to 200-N may be successfully used to clean trash from Earth's oceans and the seven seas, as well as lakes and rivers. For example, each individual vessel from among the vessels 200-1 to 200-N may be used to successfully clean the Great Pacific garbage patch.

When cleaning relatively small water bodies, for example, rivers and lakes of certain sizes, each one of the vessels 200-1 to 200-N may be dispatched to the area of trash without the backup of the cargo ship 160. In this case, the location of the trash in the water is within a range which each of the vessels 200-1 to 200-N can reach without needing to refuel (e.g., operating range). In addition, the amount of trash in the water may be small enough that one or more of the vessels 200-1 to 200-N can retrieve, shred/rip/cut, compact and pack it into trash containers 70 onto their respective loading decks without the need to offload the loaded trash containers 70 to the cargo ship 160.

The vessels 200-1 to 200-N may also be used to clean trash from the oceans or the seven seas without the backup of the cargo ship 160 when the area of the trash in the sea/ocean is within an operating distance from the shore and/or when all of the trash can be stored onboard the one or more vessels 200-1 to 200-N. When a single vessel from among the vessels 200-1 to 200-N cannot store all of the trash from the water, a plurality of vessels may be dispatched to the location of the trash, or the single vessel may perform several trips from the shore in order to capture all of the trash from the water body.

When the vessels 200-1 to 200-N are dispatched into the open ocean (e.g., beyond their operating range), the vessels 200-1 to 200-N may be refueled by the cargo ship 160 such that the vessels 200-1 to 200-N can reach the destination of the trash, and such that the vessels 200-1 to 200-N can work in two shifts (e.g., 16 hours) or in three shifts (e.g., continuously).

Accordingly, due to the configuration of each of the vessels 200-1 to 200-N, as well as due to the configuration and size of the cargo ship 160, each individual vessel as well as the system of vessels of the present invention may be used to successfully remove a large amount of trash from a water body in a short period of time. Therefore, each individual vessel and the system of vessels of the present invention may be highly efficient at cleaning large amounts of trash from a water body, whether out in the open ocean, in any of the seven seas, or in a lake or river.

While the present invention has been particularly shown and described with reference to exemplary embodiments thereof, it will be apparent to those of ordinary skill in the art that various changes in form and detail may be made therein without departing from the spirit and scope of the present invention.

What is claimed is:

1. A vessel configured to remove trash from a body of water, the vessel comprising:

a trash intake portion;

a trash processing portion;

a compactor; and a plurality of components configured to allocate compacted trash onboard the vessel;

wherein the trash intake portion includes a funnel and a trash conveyor mechanism extending between the funnel and the trash processing portion, wherein the trash conveyor mechanism includes a conveyor belt extending between the funnel and the trash processing portion, and at least one selected from a first paddle wheel disposed along a length of the conveyor belt and extending in a first direction corresponding to a width-wise direction of the conveyor belt and a second paddle wheel disposed above the conveyor belt, wherein, when the trash conveyor mechanism includes both the first and second paddle wheels, the second paddle wheel extends in a second direction crossing the first direction.

2. The vessel of claim 1, wherein the trash intake portion further includes at least one of an auxiliary crane and a trash chute.

3. The vessel of claim 2, wherein, when the trash intake portion includes the auxiliary crane, the auxiliary crane is connected to a net, a basket or a hook configured to capture trash from the body of water.

4. The vessel of claim 1, wherein the funnel includes at least one of a conveyor and a paddle.

5. The vessel of claim 4, wherein, when the funnel includes the conveyor, the conveyor is perforated, and when the funnel includes the paddle, the paddle is perforated.

6. The vessel of claim 1, wherein the funnel is pivotally coupled to a body of the vessel and is configured to be selectively pivoted between a raised state and a lowered state, and in the lowered state the funnel is configured to be at least partially submerged in the body of water.

7. The vessel of claim 1, wherein the conveyor belt extends in a third direction that crosses the first and second directions.

8. The vessel of claim 1, wherein the conveyor belt is perforated.

9. The vessel of claim 1, wherein when the vessel floats on the body of water, the conveyor belt extends at least partially over a surface of the body of water.

10. The vessel of claim 1, wherein the trash processing portion includes a housing with a first end, a second end, and a drum disposed between the first and second ends, wherein the first end is configured to receive trash from the trash intake portion, the drum is configured to grind, shred, chip, rip, or cut the received trash, and the second end is configured to output the ground, shredded, chipped, ripped or cut trash.

11. The vessel of claim 10, wherein the trash processing portion further includes a trash output member extending between the second end of the housing and the compactor, the trash output member being configured to direct the trash output from the second end of the housing to the compactor.

12. The vessel of claim 1, further comprising a first hull and a second hull spaced apart from the first hull, wherein at least one of the trash intake portion and the trash processing portion is disposed between the first and second hulls.

13. The vessel of claim 1, further comprising an encapsulating member configured to at least partially surround a compacted mass of trash that is output from the compactor.

14. The vessel of claim 13, wherein the encapsulating member is perforated.

15. The vessel of claim 1, further comprising a trash container configured to accommodate at least one compacted mass of trash therein, wherein the trash container includes a housing and a first bottom portion that is pivotally coupled to the housing such that the first bottom portion is selectively pivotable between a first position to hold the at least one compacted mass of trash inside of the housing, and a second position forming an opening at a bottom end of the trash container for ejecting the at least one compacted mass of trash therethrough.

16. A vessel configured to remove trash from a body of water, the vessel comprising:

a trash intake portion;

a trash processing portion;

a compactor; and a plurality of components configured to allocate compacted trash onboard the vessel, wherein the plurality of components includes:

first and second elongated members extending in a first direction and spaced apart from one another;

a gantry frame extending between the first and second elongated members and slidably engaged therewith such that the gantry frame can be selectively moved in the first direction along a length of the first and second elongated members; and a gantry crane slidably engaged with the gantry frame such that the gantry crane can be selectively moved on the gantry frame in a second direction that crosses the first direction.

17. The vessel of claim 16, wherein the gantry crane includes a coupling member and a cable connected to the coupling member, wherein a length of the cable is selectively adjustable such that an elevation of the coupling member can be adjusted along a third direction that crosses the first and second directions.

18. The vessel of claim 17, wherein the coupling member is shaped to resemble a claw or a hook.

19. The vessel of claim 16, wherein the gantry crane includes at least one of an accelerometer, a gyroscope and an inertial measurement unit that is usable for determining a location of a trash container that is selectively coupled to the coupling member of the gantry crane in real-time.

20. A vessel configured to remove trash from a body of water, the vessel comprising:

a trash intake portion;

a trash processing portion;

a compactor; and a plurality of components configured to allocate compacted trash onboard the vessel, wherein the compactor includes:

an input opening configured to receive ground trash;

a piston configured to compact the received trash into a mass of trash; and an output opening configured to output the mass of trash, wherein the compactor further includes an outfeed table configured to support the output mass of trash, and wherein the outfeed table is rotatably coupled to the compactor in order to allow the output mass of trash to fall downwardly by virtue of gravity.

21. The vessel of claim 20, wherein the compactor is disposed on a cargo deck of the vessel.

* * * * *